US008347770B2

(12) United States Patent
Cedar et al.

(10) Patent No.: US 8,347,770 B2
(45) Date of Patent: Jan. 8, 2013

(54) HOLE PUNCH

(75) Inventors: Jonathan Newman Cedar, Scarsdale, NY (US); Przemyslaw Godycki, Brooklyn, NY (US); Dan Reilly, Dedham, MA (US); Kenneth Zins, Fitchburg, MA (US)

(73) Assignee: Staples The Office Superstore, LLC, Framingham, MA (US)

( * ) Notice: Subject to any disclaimer, the term of this patent is extended or adjusted under 35 U.S.C. 154(b) by 426 days.

(21) Appl. No.: 12/264,329

(22) Filed: Nov. 4, 2008

(65) Prior Publication Data

US 2010/0107847 A1 May 6, 2010

(51) Int. Cl.
*B26F 1/14* (2006.01)

(52) U.S. Cl. ..... 83/634; 83/684

(58) Field of Classification Search ..... 83/684, 83/687, 688, 691, 633, 634, 635, 632, 618, 83/630, 582; D19/72
See application file for complete search history.

(56) References Cited

U.S. PATENT DOCUMENTS

| | | | | |
|---|---|---|---|---|
| 332,666 | A * | 12/1885 | Laney | 83/165 |
| 2,382,523 | A | 8/1945 | Unger | |
| 3,164,050 | A | 1/1965 | Alldis | |
| 3,906,633 | A | 9/1975 | Inoue | |
| 4,028,170 | A | 6/1977 | Savarimuthu | |
| 4,166,404 | A | 9/1979 | Almog | |
| 4,289,565 | A | 9/1981 | Wilkins | |
| 4,449,436 | A | 5/1984 | Semerjian et al. | |
| 4,640,451 | A | 2/1987 | Steiner et al. | |
| 4,713,995 | A | 12/1987 | Davi | |
| D329,254 | S * | 9/1992 | Mori | D19/72 |
| 5,273,387 | A * | 12/1993 | Groswith et al. | 412/40 |
| 5,340,229 | A | 8/1994 | Schwartzman | |
| 5,503,052 | A | 4/1996 | Rigney et al. | |
| 5,673,604 | A | 10/1997 | Rigney | |
| 5,787,783 | A | 8/1998 | Evans et al. | |
| 5,797,308 | A | 8/1998 | Evans et al. | |
| 5,829,334 | A | 11/1998 | Evans et al. | |
| 5,906,448 | A | 5/1999 | Najmi | |

(Continued)

FOREIGN PATENT DOCUMENTS

DE 3614678 C1 9/1987

(Continued)

OTHER PUBLICATIONS

International Search Report and Written Opinion in corresponding PCT application No. US2009/005904 dated Feb. 9, 2010.

*Primary Examiner* — Stephen Choi
(74) *Attorney, Agent, or Firm* — Wolf, Greenfield & Sacks, P.C.; Randy J. Pritzker

(57) ABSTRACT

A hole punch includes a base and a handle assembly to actuate a punch pin. The base may include a housing enclosing a punch head, and the housing may include an opening where the handle assembly is adapted to be recessed within the opening. The handle assembly may include a first linkage and a second linkage, each pivotally coupled to the base, and a third linkage pivotally coupled to both the first and second linkages, where the third linkage is arranged to move substantially parallel to the base. The first linkage may be substantially parallel to the second linkage when the punch pin is in a rest position, and the second linkage may be configured to nest within the first linkage when the punch pin is in a deployed position.

17 Claims, 14 Drawing Sheets

U.S. PATENT DOCUMENTS

| | | | | |
|---|---|---|---|---|
| 5,989,173 | A | 11/1999 | Lugea et al. | |
| 6,032,566 | A | 3/2000 | Evans et al. | |
| D433,708 | S * | 11/2000 | Chiang | D19/72 |
| 6,752,057 | B2 * | 6/2004 | Oh | 83/549 |
| 6,918,332 | B1 * | 7/2005 | Andersen | 83/589 |
| 7,066,002 | B2 * | 6/2006 | Price et al. | 83/634 |
| 7,819,045 | B2 * | 10/2010 | Chang | 83/633 |
| 2003/0010176 | A1 * | 1/2003 | Chiang | 83/618 |
| 2005/0034583 | A1 | 2/2005 | Mori et al. | |
| 2005/0211041 | A1 * | 9/2005 | Oh | 83/588 |
| 2007/0044618 | A1 | 3/2007 | Marks | |
| 2007/0044623 | A1 | 3/2007 | Marks | |
| 2007/0044624 | A1 | 3/2007 | Marks | |
| 2007/0169603 | A1 | 7/2007 | Marks | |
| 2007/0199424 | A1 | 8/2007 | Marks | |
| 2007/0234866 | A1 * | 10/2007 | Kandasamy et al. | 83/588 |
| 2007/0266836 | A1 | 11/2007 | Marks | |
| 2007/0267472 | A1 | 11/2007 | Marks | |
| 2008/0236353 | A1 * | 10/2008 | Kent et al. | 83/167 |
| 2009/0223341 | A1 * | 9/2009 | Huang | 83/588 |

FOREIGN PATENT DOCUMENTS

| | | | |
|---|---|---|---|
| DE | 20112699 | U1 | 11/2001 |
| DE | 10051625 | A1 | 5/2002 |
| EP | 1332845 | B1 | 8/2003 |
| EP | 1332846 | A2 | 8/2003 |
| EP | 1332847 | B1 | 7/2005 |
| EP | 1332849 | B1 | 7/2005 |
| GB | 2384739 | | 7/2005 |
| WO | WO 95/11113 | | 4/1995 |
| WO | WO 2007/038439 | A1 | 4/2007 |

* cited by examiner

HOLE PUNCH

FIELD OF INVENTION

The present invention relates to hole punches and more particularly to desktop hole punches for piercing holes through paper.

BACKGROUND OF INVENTION

Hole punches are employed to create holes through sheets of paper to allow a user to place the sheets of paper in a ring binder. Typically, the hole punch includes one or more punch pins acted upon by a handle whereby actuation of the handle causes each punch pin to pierce through the paper and create a hole.

Hole punches are often configured so that a user must pivot the handle to cause the punch pins to pierce through the paper. As the stack of paper to be punched increases from one to many sheets, the effort necessary to create the holes also increases and the pivoting motion of the handle may become more difficult and may not work well with larger stacks of paper. Hole punches may also be cumbersome and difficult to store in smaller work spaces.

SUMMARY OF INVENTION

In one aspect of the invention, a hole punch is disclosed. The hole punch includes a base, a handle assembly arranged to move relative to the base, and at least one punch head mounted to the base. The punch head has a punch pin, and the handle assembly is adapted to engage the punch pin and move the punch pin from a rest position to a deployed position upon actuation of the handle assembly. The base includes a housing at least partially enclosing the at least one punch head, and the housing includes at least one opening where at least a portion of the handle assembly is adapted to be recessed within the at least one opening.

In another aspect of the invention, a hole punch is disclosed. The hole punch includes a base and a handle assembly arranged to move relative to the base. The handle assembly includes a first linkage pivotally coupled to the base, a second linkage pivotally coupled to the base, and a third linkage pivotally coupled to both the first linkage and the second linkage. The third linkage is arranged to move substantially parallel to at least a portion of the base. The hole punch further includes at least one punch head mounted to the base and the punch head has a punch pin. The first linkage is adapted to engage the punch pin and move the punch pin from a rest position to a deployed position upon actuation of the first linkage by movement of the third linkage in a direction substantially parallel to at least a portion of the base.

In yet another aspect of the invention, a hole punch is disclosed. The hole punch includes a base, a handle assembly arranged to move relative to the base, and at least one punch head mounted to the base. The punch head has a punch pin, and the handle assembly is adapted to engage the punch pin and move the punch pin from a rest position to a deployed position upon actuation of the handle assembly. The handle assembly includes a first linkage pivotally coupled to the base and a second linkage pivotally coupled to the base, where the first linkage is substantially parallel to the second linkage when the punch pin is in the rest position, and where the second linkage is configured to nest within the first linkage when the punch pin is in the deployed position.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
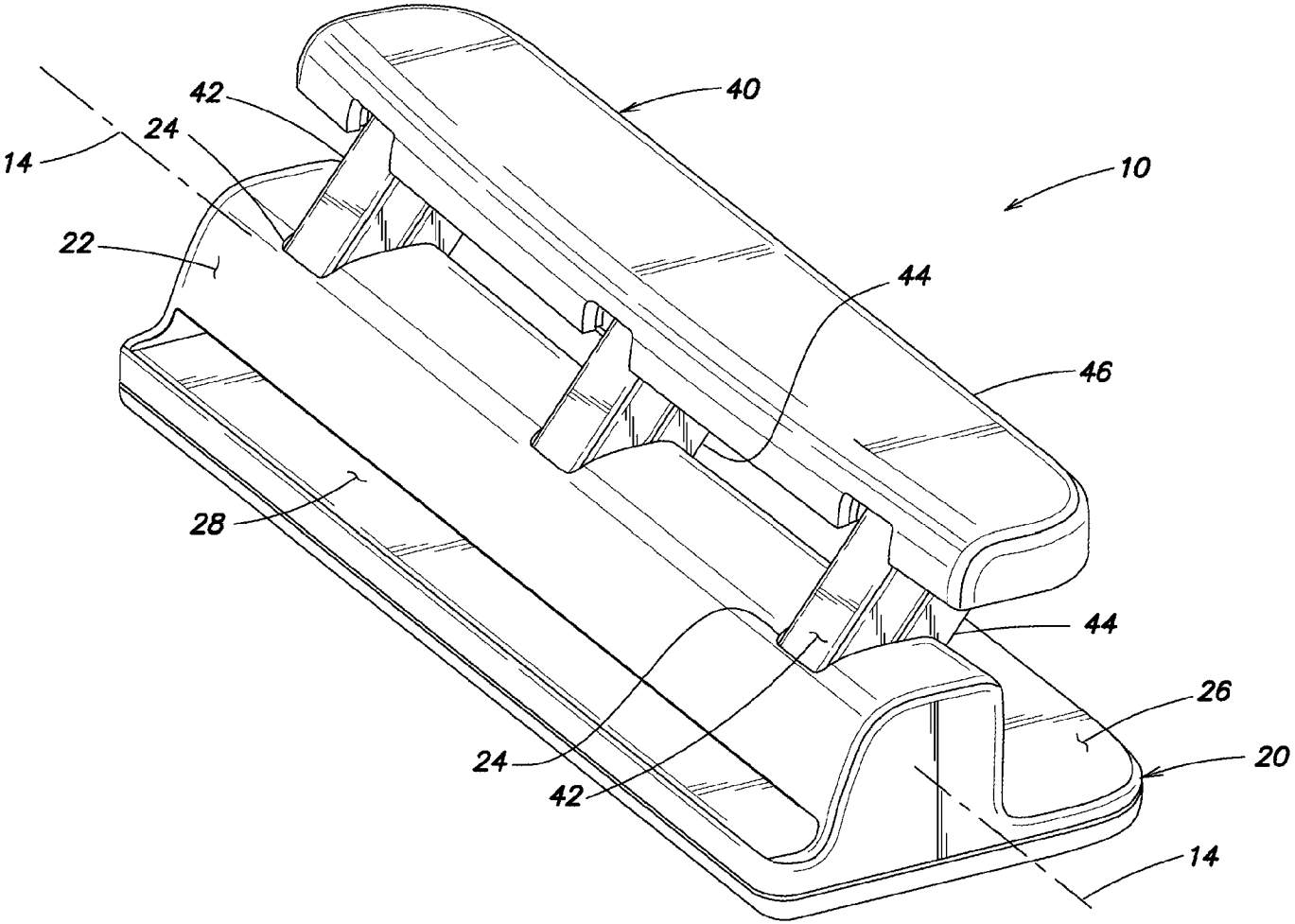
FIG. 1 is a perspective front view of an illustrative embodiment of a hole punch shown in a pre-actuation position.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Aspects of the invention are directed to a hole punch used to create holes through material, such as but not limited to, one or more sheets of paper. The holes may be created through the paper to allow a user to place the sheets of paper in a ring binder. The hole punch includes a base and at least one punch head mounted to the base, and the punch head includes a punch pin configured to pierce the holes into the paper. The hole punch also includes a handle assembly which actuates the punch pin. It should be appreciated that the hole punch may also be configured to create holes through non-paper material, as the invention is not so limited.

Certain embodiments of the present invention are directed to a hole punch having a handle assembly which is configured to make it easier for a user to actuate the punch pin. As discussed in greater detail below, the handle assembly may be configured to actuate the punch pin by linear movement of a portion of the handle assembly. The handle assembly may be configured to actuate the punch pin by movement of a portion of the handle assembly in a direction substantially parallel to at least a portion of the base.

Other embodiments of the present invention are directed to a hole punch where the base has a housing which at least partially encloses the punch head. The housing includes at least one opening and a portion of the handle assembly is adapted to be recessed within the opening. In one embodiment, a portion of the handle assembly may be recessed into the opening when the hole punch is in a stowed configuration.

In one embodiment, the handle assembly of the hole punch includes a first linkage and a second linkage each pivotally coupled to the base. The second linkage may be configured to nest within the first linkage when the punch pin is in a deployed position. The second linkage may also nest within the first linkage when the hole punch is in a stowed configuration.

Turning now to the drawings, it should be appreciated that the drawings illustrate various components and features which may be incorporated into various embodiments of the present invention. For simplification, some of the drawings may illustrate more than one optional feature or component. However, the present invention is not limited to the specific embodiments disclosed in the drawings. It should be recognized that the present invention encompasses embodiments which may include only a portion of the components illustrated in any one figure, and/or may also encompass embodiments combining components illustrated in multiple different drawings.

In FIGS. 1-7, a hole punch 10 is illustrated. The hole punch 10 includes a base 20 having a longitudinal axis 14 running lengthwise relative to the base 20. The hole punch 10 includes one or more punch heads 18 (see FIGS. 6 and 9-11) and a handle assembly 40 to actuate the punch heads 18. As discussed in greater detail below, a downward movement of at least a portion of the handle assembly 40 causes a downward movement of the punch heads 18. A punch head 18 may include a punch pin 98, and actuation of the punch pin 98 via the handle assembly 40 causes the punch pin 98 within the punch head 18 to pierce through one or more sheets of paper (not shown). In this regard, upon actuation of the handle assembly 40, the punch pin 98 moves from a rest position (shown in FIGS. 1, 3 and 6) to a deployed position (shown in FIGS. 2 and 4). In one illustrative embodiment, the punch pin 98 have a rounded protrusion with sharp edges configured to cut through the paper to create a hole in the paper.

In one illustrative embodiment the base 20 includes a housing 22 which at least partially encloses the punch heads 18. The housing 22 may have at least one opening 24 and at least a portion of the handle assembly 40 may be recessed into the opening 24. In one embodiment, the handle assembly 40 may be recessed into the opening 24 when the punch pin 98 moves into a deployed position (shown in FIGS. 2 and 4). As discussed in greater detail below, in one embodiment, a portion of the handle assembly 40 may collapse into the opening 24 when the hole punch 10 is in a stowed configuration.

In one embodiment, the housing 22 may enclose a substantial portion of the punch head 18. As shown in FIGS. 1-4, the punch heads 18 may be hidden from ordinary view by the housing 22. In such embodiments, the housing 22 may include a second opening 28 arranged to receive the paper (not shown) into the housing 22. The second opening 28 may be configured to align the paper with the punch heads 18. It should be appreciated that in one embodiment, portions of the punch head 18 may not be hidden by the housing 22, as the invention is not limited in this respect In one illustrative embodiment, the handle assembly 40 includes a first linkage 42 pivotally coupled to the base 20. As shown in the partial assembly views of FIGS. 9 and 10, the punch head 18 may be mounted to the base 20 and the first linkage 42 may be pivotally coupled to the punch head 18. As illustrated in the cross-sectional view of FIG. 6, the first linkage 42 may be pivotally coupled to the punch head 18 at pin 80. In this embodiment, the first linkage 42 is arranged to pivot relative to the base 20 about an axis 30 defined by the pin 80. In one illustrative embodiment, this axis 30 is substantially parallel with the longitudinal axis 14 of the base 20. It should be appreciated that in other embodiments, the first linkage 42 may be coupled to the base 20 differently, and the axis 30 may be oriented to be non-parallel and perhaps perpendicular to the longitudinal axis 14 of the base 20, as the invention is not so limited.

Figure 6:
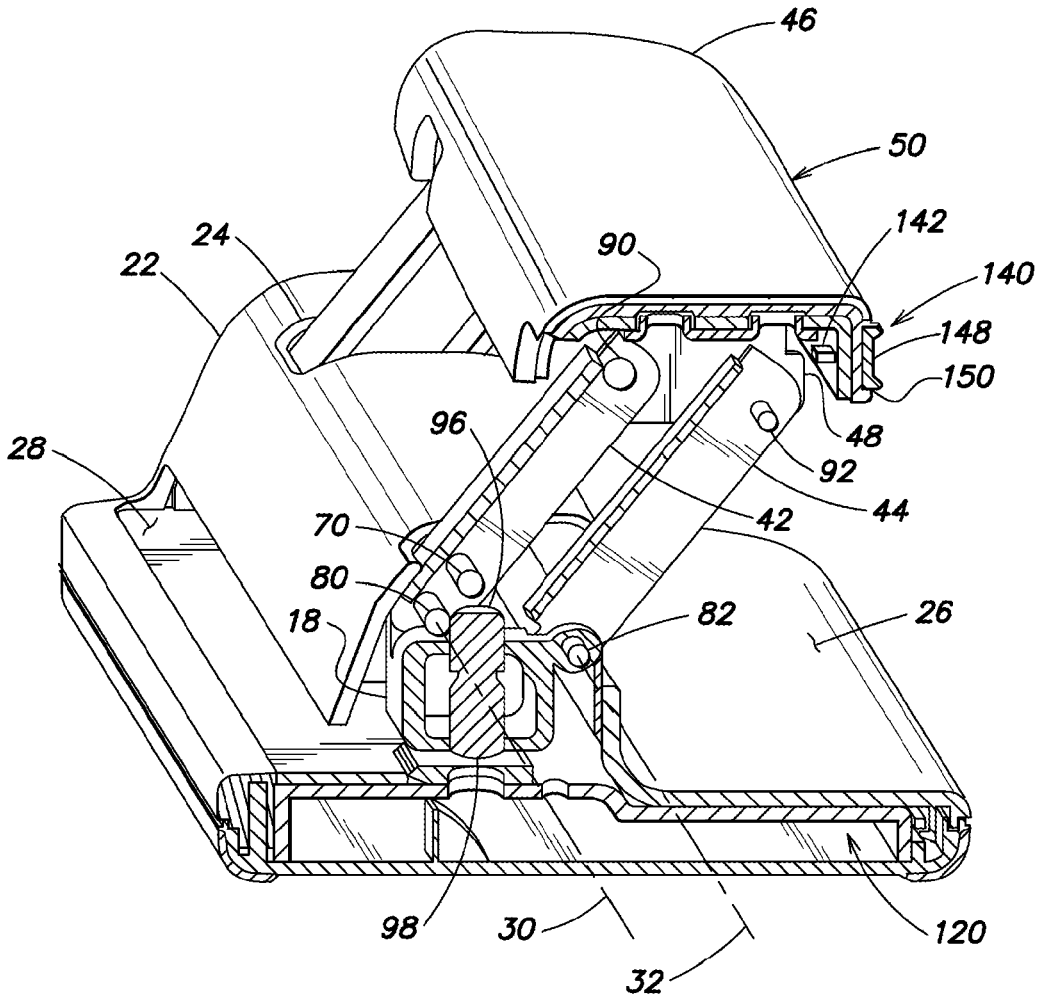
FIG. 6 is a cross-sectional view of the hole punch of FIG. 1 taken along line 6-6 shown in FIG. 5.

As illustrated in the cross-sectional view of FIG. 6, the first linkage 42 may be adapted to engage the punch pin 98 and move the punch pin 98 from a rest position to a deployed position. In this particular embodiment, the first linkage 42 has a pin 70 configured to engage the upper surface 96 of the punch pin 98 to move the punch pin downwardly into its deployed position. In another embodiment, the first linkage 42 may be configured in a different manner to engage the punch pin 98 as the invention is not so limited.

Figure 10:
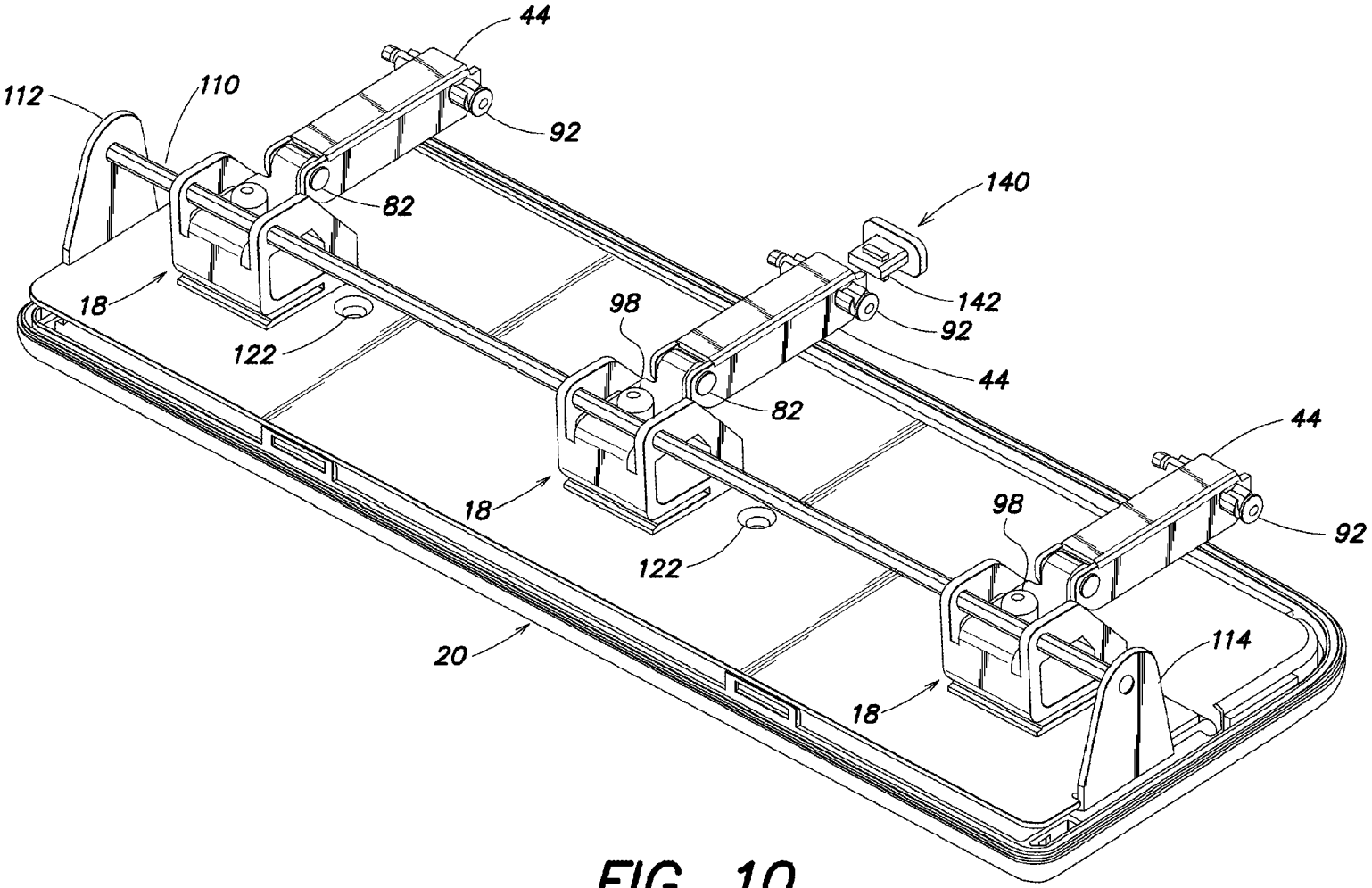
FIG. 10 is a perspective front view of an illustrative embodiment of a partially assembled hole punch.

In one illustrative embodiment, the handle assembly 40 includes a second linkage 44 pivotally coupled to the base 20. As shown in the partial assembly views of FIG. 10, the second linkage 44 may be pivotally coupled to the punch head 18. As illustrated in FIGS. 6 and 10, the second linkage 44 may be pivotally coupled to the punch head 18 at pin 82. In this embodiment, the second linkage 44 is arranged to pivot relative to the base 20 about an axis 32 defined by the pin 82. In one illustrative embodiment, this axis 32 is substantially parallel with the longitudinal axis 14 of the base 20 and with the axis 30. It should be appreciated that in other embodiments, the second linkage 44 may be coupled to the base 20 differently, and the axis 32 may be oriented to be non-parallel and perhaps perpendicular to the longitudinal axis 14 of the base 20 and/or the axis 30, as the invention is not so limited.

The second linkage 44 may be configured to provide support to the handle assembly 40 as the handle assembly moves between the pre-actuation position and the punch position. In one embodiment, the second linkage 44 is configured to bias the handle assembly 40 in the pre-actuation or rest position of FIGS. 1 and 3. In this respect, after the handle assembly is pressed into its punch position shown in FIGS. 2 and 4 to actuate the punch downwardly to punch a hole, the second linkage 44 may be configured to return the handle assembly 40 back to its pre-actuation position. It should be appreciated that in another embodiment one or more springs may be configured to bias the handle assembly 40 in the pre-actuation position. It should be appreciated that some embodiments may not have a second linkage 44 pivotally coupled to the base 20 as the invention is not so limited.

In one illustrative embodiment, the handle assembly 40 further includes a third linkage 46 which is pivotally coupled to both the first linkage 42 and the second linkage 44. In particular, as shown in FIG. 6, the first linkage 42 is pivotally coupled to the third linkage 46 at pin 90 and the second linkage 44 is pivotally coupled to the third linkage 46 at pin 92. The handle assembly 40 may be configured such that a user may press down on the third linkage 46 to actuate the punch pin 98 into its deployed position.

Figure 3:
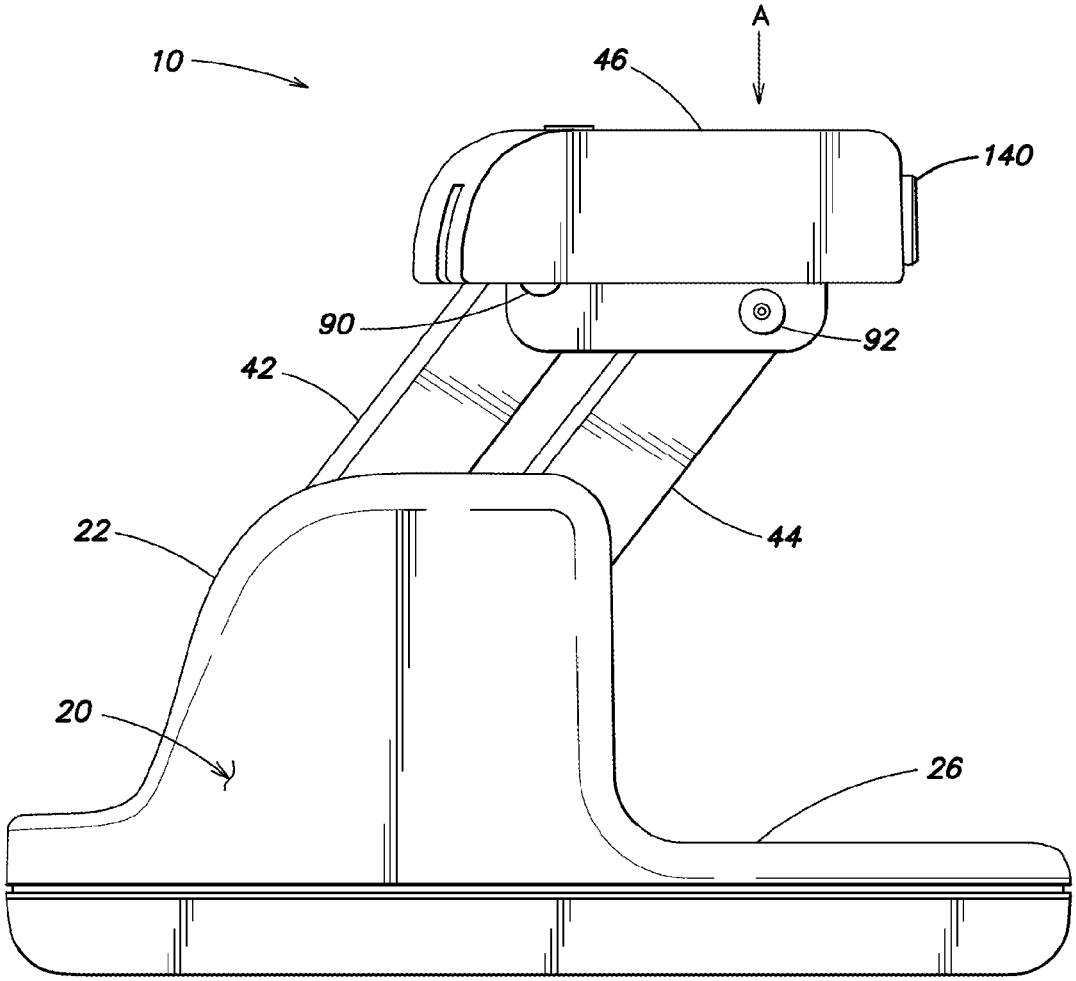
FIG. 3 is a side view of the hole punch of FIG. 1 shown in a pre-actuation position.
Figure 4:
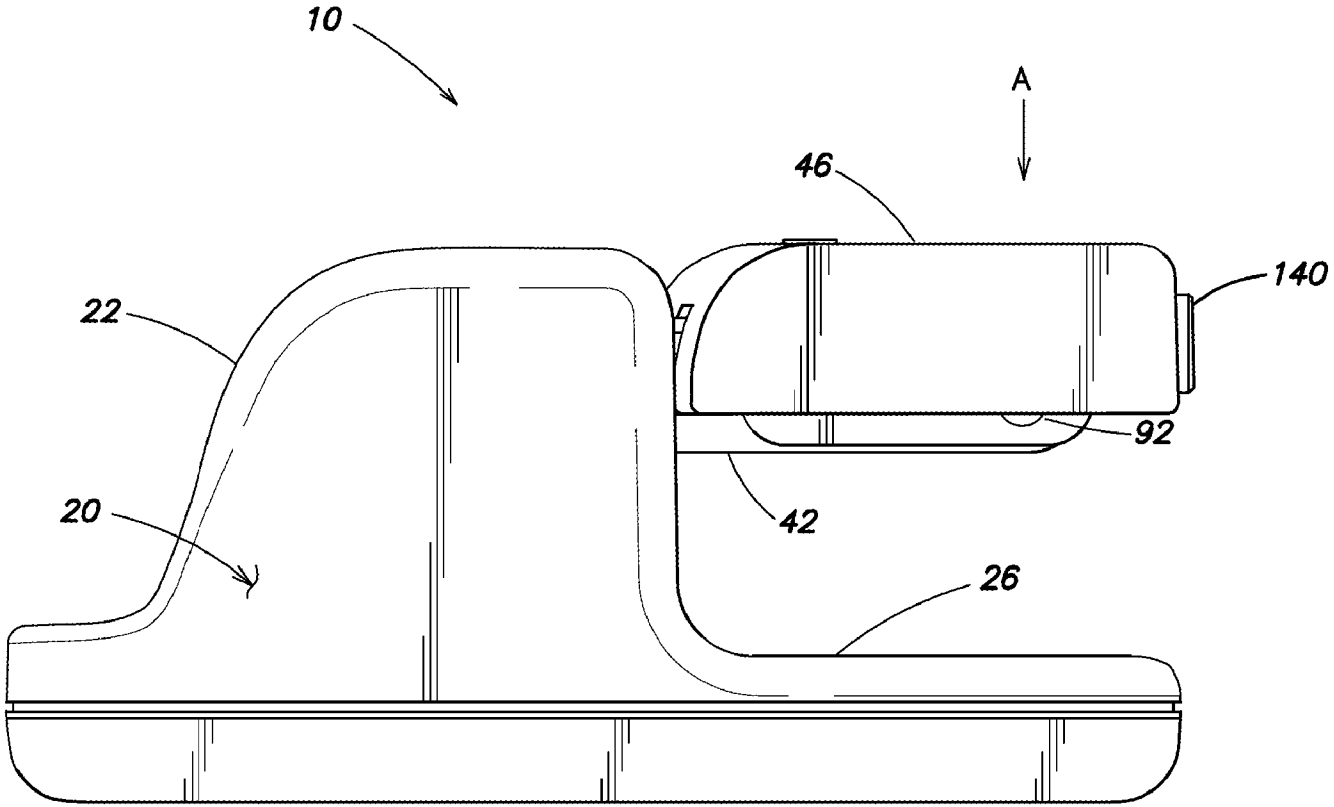
FIG. 4 is a side view of the hole punch of FIG. 1 shown in a punch position.
Figure 5:
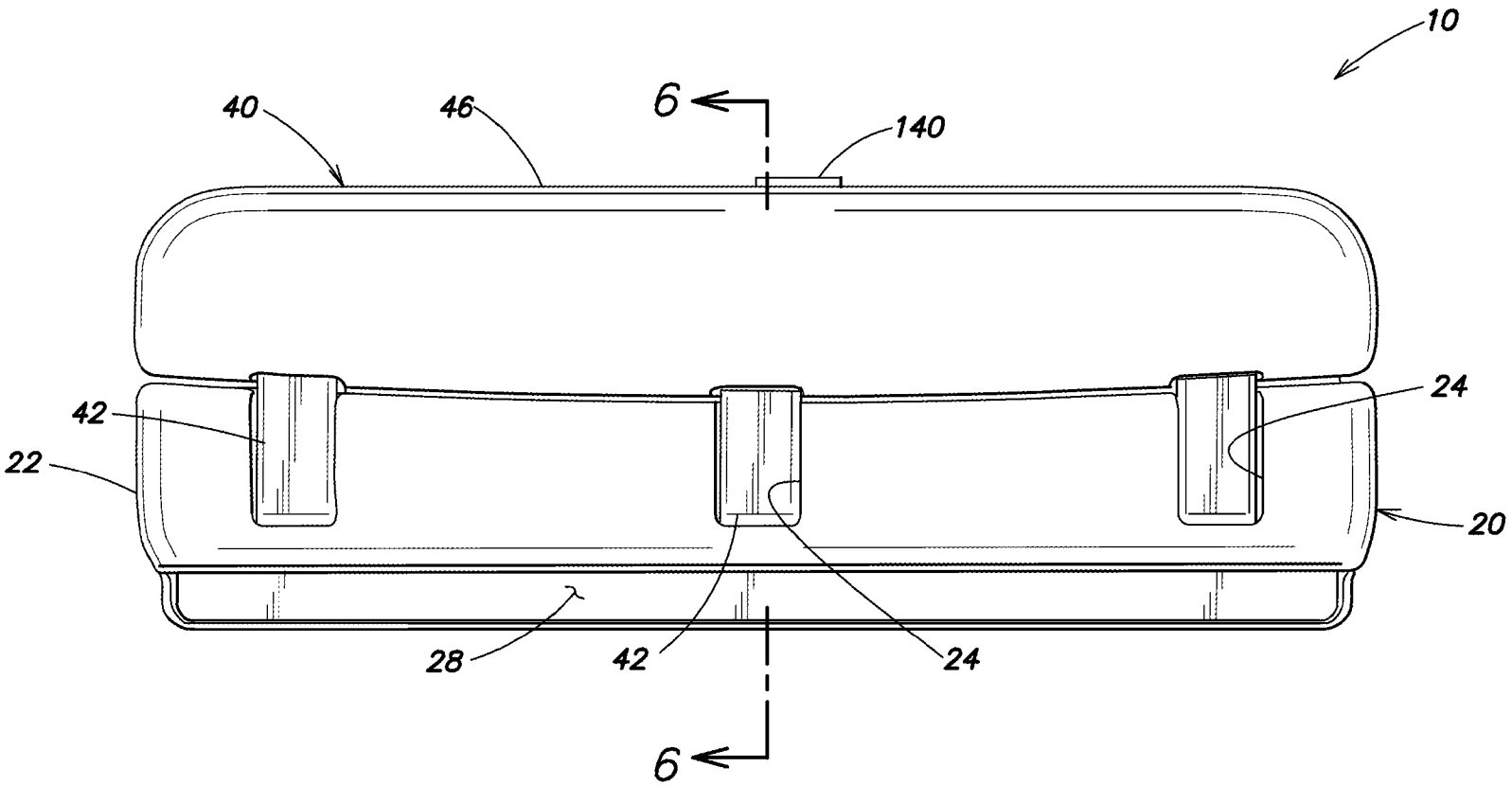
FIG. 5 is a top view of the hole punch of FIG. 1.

In one embodiment, linear movement of the third linkage 46 actuates the punch pin 98. In one illustrative embodiment, movement of the third linkage 46 in a direction substantially parallel to at least a portion of the base 20 actuates the handle assembly which moves the punch pin 98. As shown in FIGS. 3 and 4, linear movement of the third linkage 46 in the direction of arrow A rotates the first linkage 42 in a clockwise direction (see FIGS. 3, 4 and 6) which moves the punch pin 98 into its deployed position. The base 20 may include a substantially planar surface 26 adjacent the housing 22, and as shown in FIGS. 3-4, the third linkage 46 is arranged to move substantially parallel to the substantially planar surface 26 of the base.

In this regard, upon pressing down on the third linkage 46 in the direction along arrow A (see FIGS. 3 and 4), the first linkage 42 rotates about pivot axis 30 (see FIG. 6) and engages the upper surface 96 of the punch pin 98. As a result, the linkages 42, 44, 46 move from the pre-actuation or rest position of FIGS. 1 and 3 to the closed or punch position shown in FIGS. 2 and 4.

Figure 7:
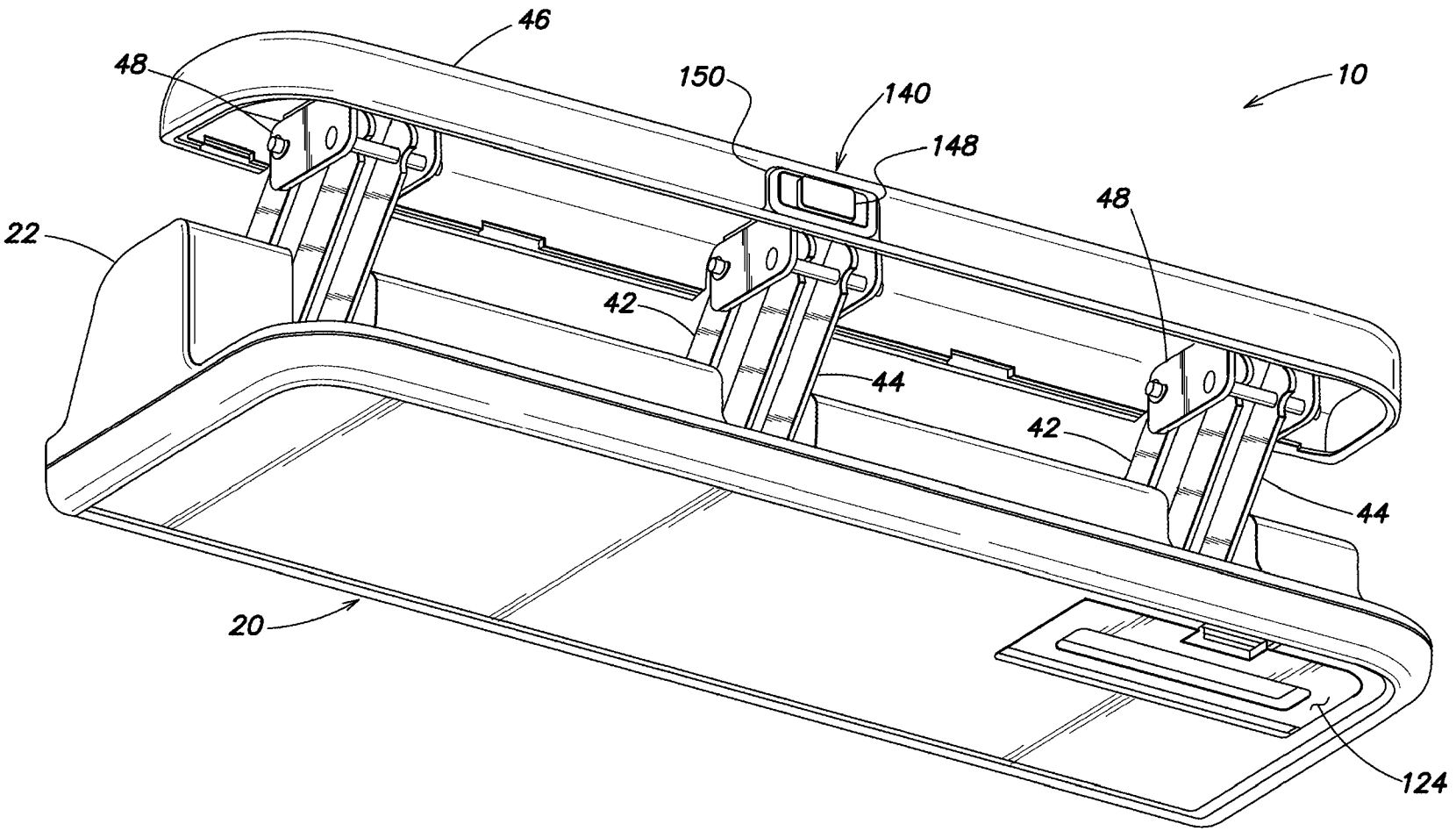
FIG. 7 is a perspective rear view of the hole punch of FIG. 1.
Figure 8:
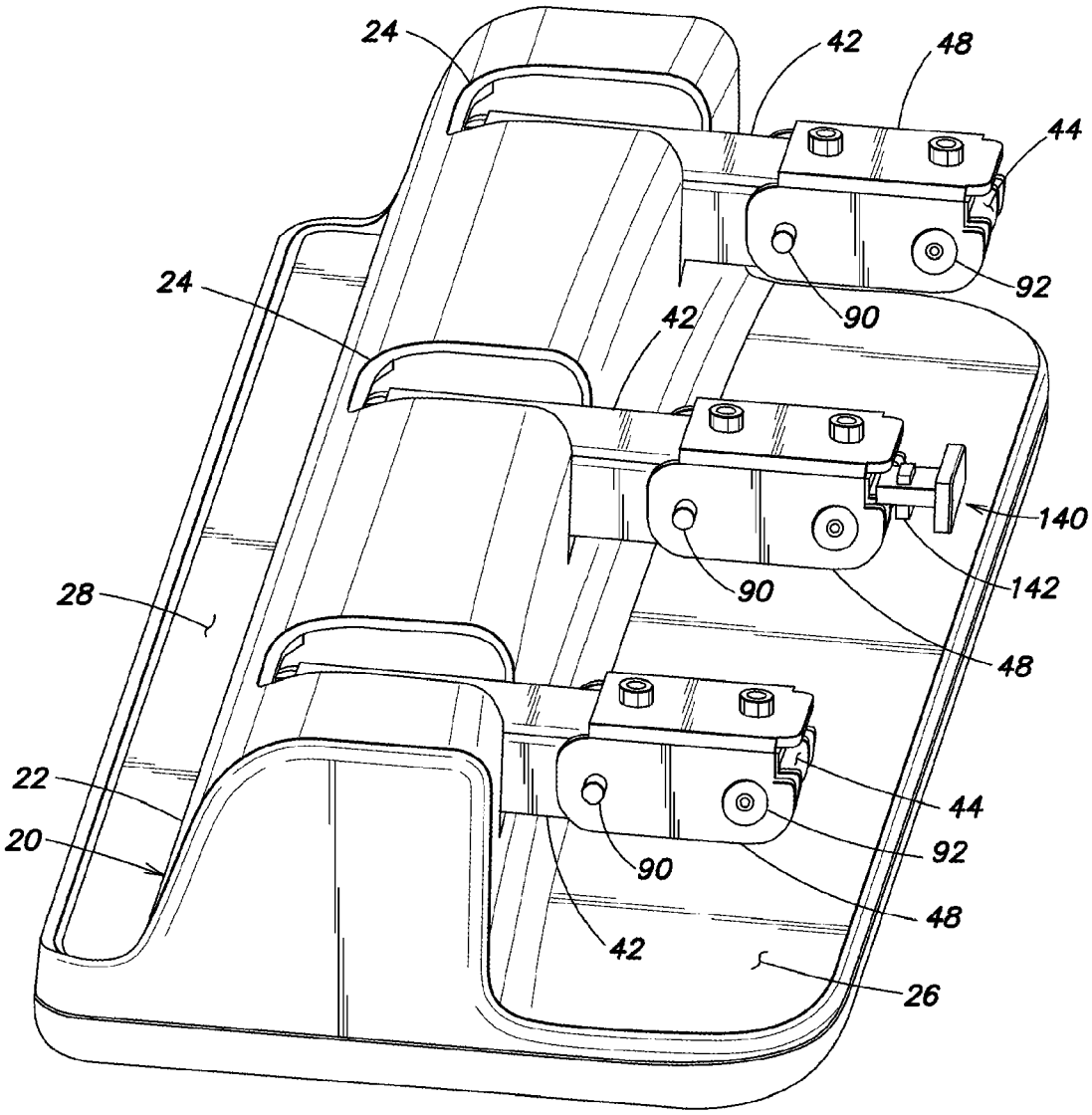
FIG. 8 is a perspective rear view of an illustrative embodiment of a partially assembled hole punch.

As shown in FIGS. 6-7, in one embodiment, the third linkage 46 includes at least two components including a lower component 48 which is pivotally coupled to the first and second linkages 42, 44 at pins 90, 92 and an upper component 50 which may connect the one or more lower components 48. As shown in FIG. 8, in one embodiment the hole punch 10 may include a plurality of lower components 48. In another embodiment shown in FIG. 13, one lower component 48 may extend across the length of the hole punch. The upper component 50 may act as a cover which may at least partially enclose the pivotal connections at pins 90, 92. As shown in FIG. 6, the upper component 50 may have a substantially U-shaped cross-section. In one embodiment, the upper component 50 of the third linkage 46 extends substantially across the length of the base 20. In one embodiment, the upper component 50 may be formed of a higher friction material such as a thermal plastic elastomer (TPE) to assist a user in applying a force to the upper component 50 to actuate the handle assembly 40.

In one embodiment, the hole punch 10 is configured to collapse into a stowed configuration in which the hole punch 10 takes up a smaller size than it does in its pre-actuation position shown in FIG. 1. At least a portion of the handle assembly 40 may collapse into the base 20 to reduce the overall volume of the hole punch when the hole punch 10 is stored in its stowed configuration. As mentioned above, in one embodiment, at least a portion of the handle assembly 40 is configured to be recessed into the housing 22 of the base 20. In one embodiment, the first linkage 42 is adapted to be recessed into the opening 24 when the handle assembly is in the punch position and the punch pin 98 is in the deployed position.

Figure 2:
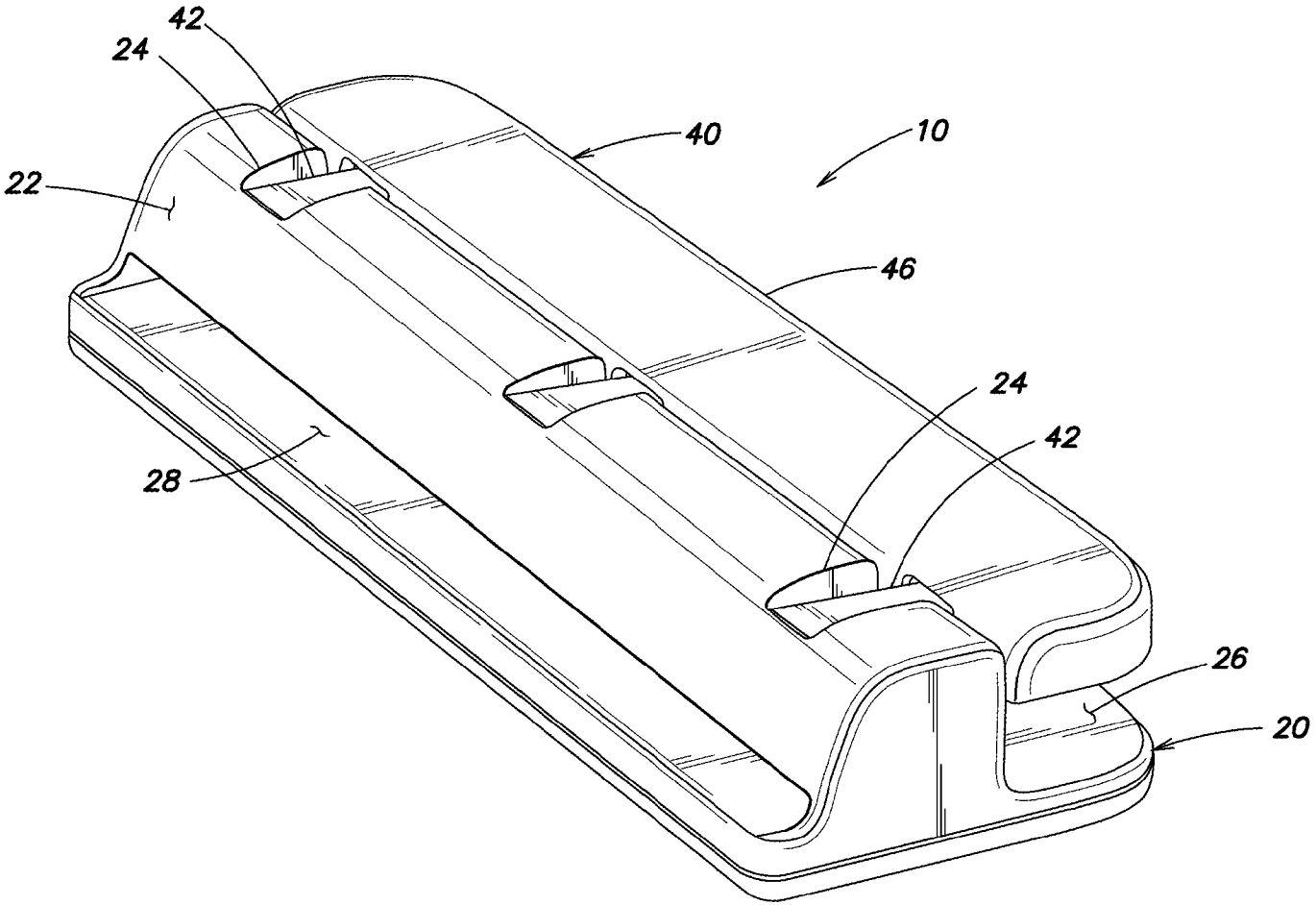
FIG. 2. is a perspective front view of the hole punch of FIG. 1 shown in a punch position.

In the illustrative embodiment, the first and second linkages 42, 44 are arranged in a manner such that the second linkage 44 may be configured to nest within the first linkage 42 when the punch pin 98 is in the deployed position (see FIGS. 2 and 4). In this respect, one linkage of the handle assembly may collapse over another linkage of the handle assembly which may reduce the overall size of the handle assembly 40 in the stowed configuration. In one embodiment, the first and second linkages 42, 44 are substantially parallel to each other when the punch pin 98 is in the rest position (see FIGS. 1 and 3).

As shown in FIG. 7, in one embodiment, the first and second linkages 42, 44 may also be configured to nest within the third linkage 46. In this illustrative embodiment, the first and second linkages 42, 44 are configured to nest within the lower component 48 of the third linkage 46. This nesting relationship may further allow the hole punch to collapse in the stowed configuration.

FIGS. 8-11 illustrate partially assembled views of the hole punch 10. In particular, FIG. 8 illustrates the hole punch 10 with the upper component 50 of the third linkage 46 omitted. This illustrates the lower component 48 of the third linkage 46 in greater detail and its pivot pin 90, 92 connections with the first and second linkages 42, 44, respectively. As mentioned above, the lower component 48 may include one or more components, as the invention is not so limited. As shown, the first and second linkages 42, 44 may nest within the lower component 48 of the third linkage 46 when the handle assembly 40 is in the punch position.

Figure 9:
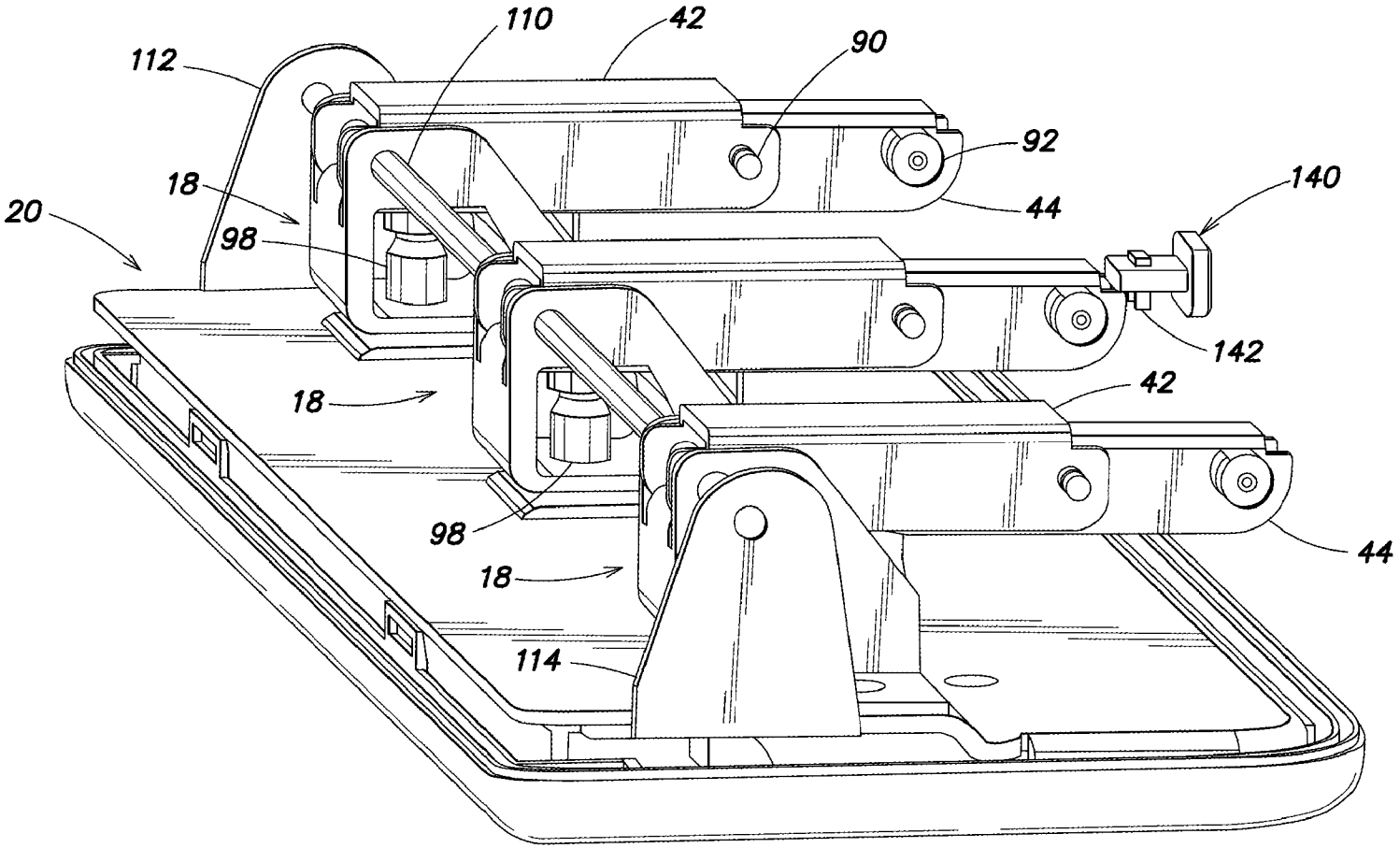
FIG. 9 is a perspective front view of an illustrative embodiment of a partially assembled hole punch.

FIG. 9 illustrates the partially assembled hole punch 10 of FIG. 8 with the base housing 22 and the lower component 48 of the third linkage 46 omitted. FIG. 9 illustrates the punch heads 18 in greater detail and also illustrates the nesting relationship of the first and second linkages 42, 44. As shown in FIG. 9, a pin 110 may extend through the punch heads 18 tying and pivotally connecting the first linkages 42 together. In one embodiment, the pin 110 extends substantially across the length of the base 20 and connects to the base 20 at opposite upstanding portions 112, 114. It should be appreciated that the pin 110 may form the above-described pin 80 (see FIG. 6) about which the first linkage 42 pivots relative to the base 20. Extending the pin 110 across a plurality of punch heads 18 may help to distribute the force applied on the third linkage 46 across a plurality of first linkages 42 to actuate the punch pins 98.

FIG. 10 also illustrates the partially assembled hole punch 10 of FIGS. 8 and 9 with the first linkages 42 omitted to illustrate the pivotal connection between the second linkage 44 and the punch heads 18 on the base 20. As discussed above, a pin 82 pivotally connects the second linkage 44 to the punch head 18.

Figure 11B:
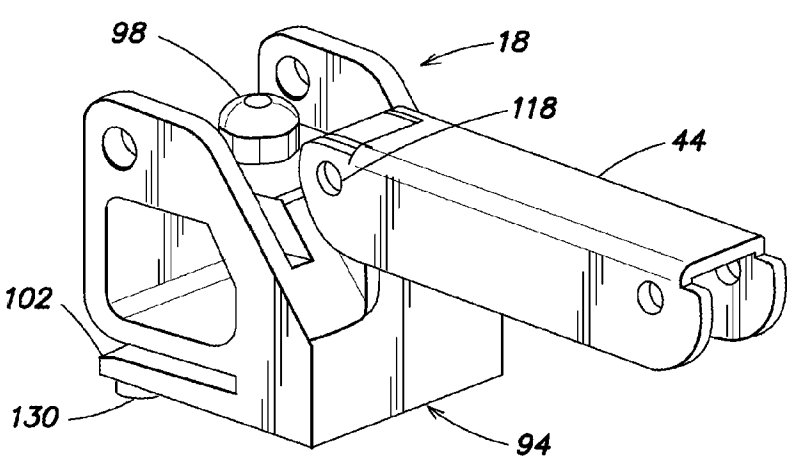
FIGS. 11A-11C are perspective rear views of illustrative embodiments of a partially assembled punch head.
Figure 11A:
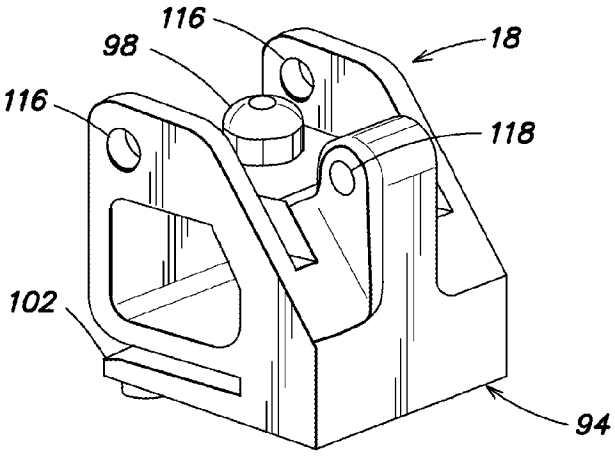
Figure 11C:
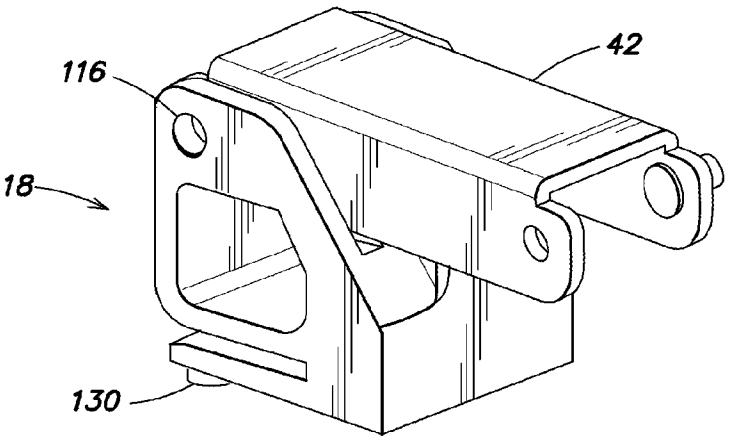

FIGS. 11A-11C further illustrate a punch head 18 and the pivotal connection to the first and second linkages 42, 44. FIG. 11A illustrates the punch head 18 alone. As shown, the punch head 18 may include at least one opening 116 to receive the pin 110 and at least one opening 118 to receive the pin 82. FIG. 11B illustrates the punch head 18 aligned with the second linkage 44 with the pin 82 omitted for simplification, and FIG. 11C illustrates the punch head 18 aligned with the first linkage 42 with the pin 110 omitted for simplification.

As shown in FIG. 11C, in one embodiment, the first linkage 42 has a substantially U-shaped cross-section, and as shown in FIG. 11B, in one embodiment, the second linkage 44 has a substantially U-shaped cross-section. As mentioned above, the second linkage may be configured to nest within the first linkage 44. This U-shape enables the nesting relationship. As shown in FIG. 8, the lower component 48 of the third linkage 46 may also have a substantially U-shaped cross-section which enables the nesting of the linkages. It should be appreciated that other linkage cross-sections, such as V-shaped, and rectangular-shaped are also contemplated, as the invention is not so limited.

The punch head 18 may be formed of any suitable materials as the present invention is not limited in this regard. In one embodiment, the punch head 18 is at least partially formed of a low friction material, thereby allowing for further ease of entry of the sheet material. In one embodiment, the punch head is formed of a metallic material that may be coated with a low friction material. In still other embodiments, the punch head may be formed of a durable plastic material. Combinations of materials are also contemplated, as the present invention is not limited in this respect.

Referring in particular to FIGS. 11A-11C, in one embodiment, the punch head 18 includes a frame 94 and a punch pin 98. The frame 94 includes a foot 102. In one embodiment, a spring (not shown) may bias the punch pin 98 toward the pin 70 of the first linkage 42 when in a rest position. Upon actuation of the hole punch, as explained above, the first linkage 42 moves downward to force the punch pin 98 from its rest position, thereby deploying the cutting end of the punch pin 98 through the end of the frame 94 toward the foot 102 to pierce through the sheet material. In one embodiment, the frame 94 is formed of a metal material; however, the present invention is not limited in this regard as any suitable materials may be employed.

As is conventional, the punch pin 98 is formed so as to produce a circular hole. However, the shape of the cutting end may be any desired shape, as the present invention is not limited in this regard. For example, the cutting end may have a cross section in the shape of a polygon, such as, a square, a rectangle, or a triangle, or other shapes, such as an oval, a star, or a heart. Other desired shapes may be employed.

The punch heads 18 are fixed to the base 20, in one embodiment, via posts 130 (see FIGS. 11A-11C) which downwardly extend from the punch heads 18. In this regard, the base 20 includes a hole (not shown) through which the posts 130 pass. Of course, other suitable attachment arrangements may be employed, as the present invention is not limited in this respect.

The hole punch 10 may be configured such that the spacing between the holes produced in the item to be punched is fixed; however, the present invention is not limited in this regard as the punch heads may be adjustable relative to the base. In one embodiment, the base includes a series of mounting areas including a plurality of spaced apart mounting holes 122 (see FIG. 10).

According to one embodiment of the invention, the hole punch 10 includes a lock 140 to hold the position of the linkages 42, 44, 46 in a stowed configuration. The stowed configuration need not necessarily be the completely closed position but rather it can be a position between the open (or pre-actuation) position and the closed (or punch) position, as the present invention is not limited in this respect. In one embodiment, the stowed configuration of the lever system is the closed or punch position (see FIGS. 2 and 4).

In the embodiment illustrated in FIGS. 6, 7 and 8-10, the lock 140 is disposed on the handle assembly 40 and in particular, on the third linkage 46. The lock 140 includes a detent 142 that engages with another linkage 42, 44 to prevent movement of the linkages 42, 44, 46. As shown in FIG. 7, to move the lock 140 to the locked position where the detent 142 is engaged and to an unlocked position where the detent is disengaged, a slide member 148 is attached to the detent 142. When assembled, the slide member 148 may be positioned within a recess 150 formed in the third linkage 46 so as to maintain a low profile design.

Figure 12:
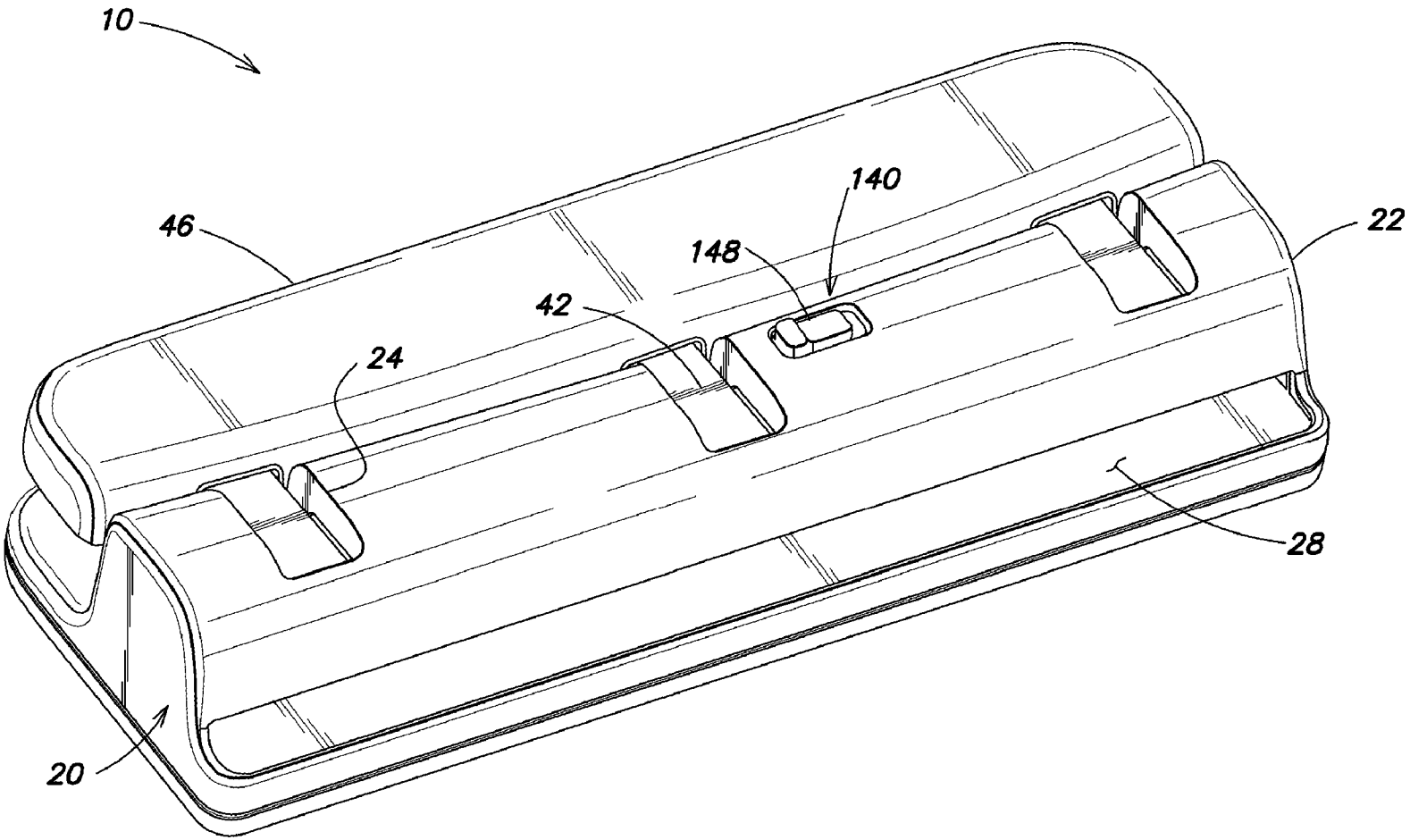
FIG. 12 is a perspective front view of another illustrative embodiment of a hole punch.
Figure 13:
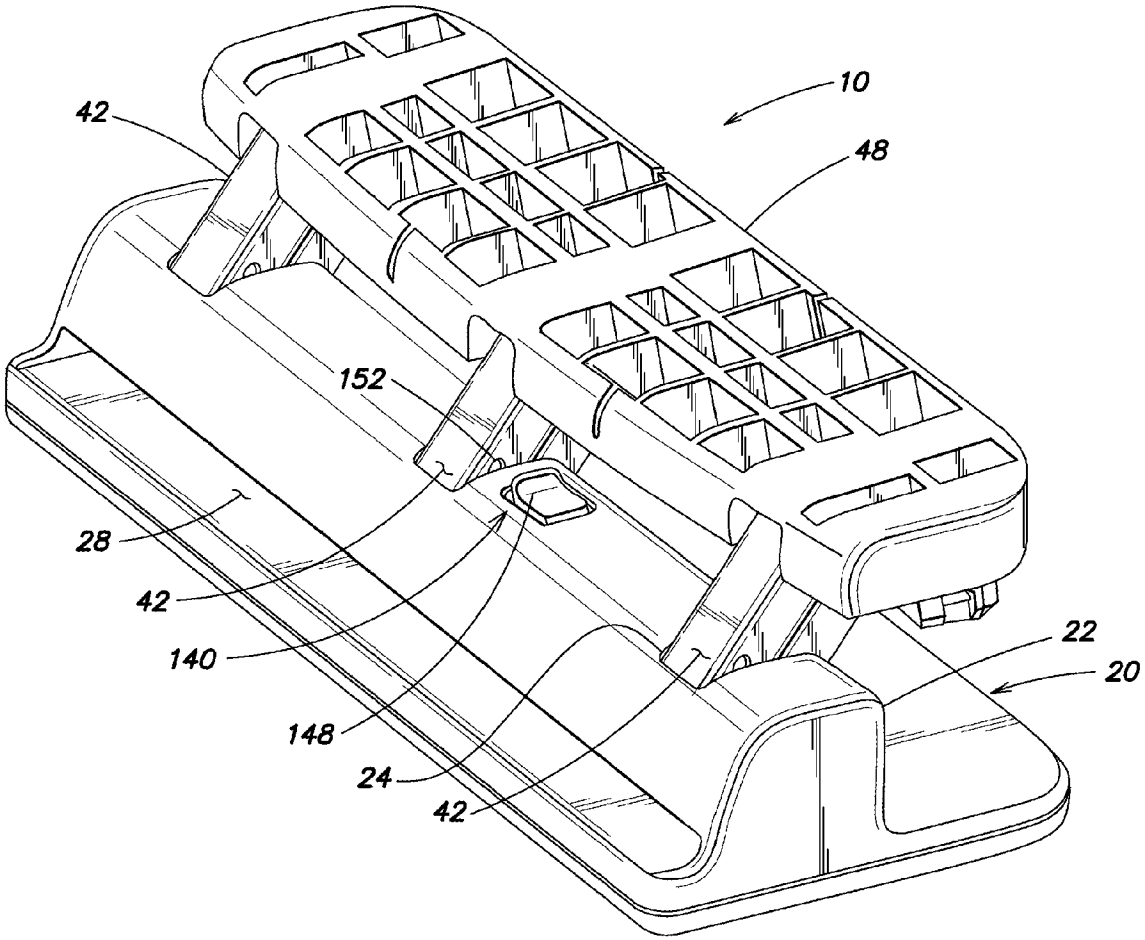
FIG. 13 is perspective front views of the hole punch of FIG. 12 shown in an unlocked position.
Figure 14:
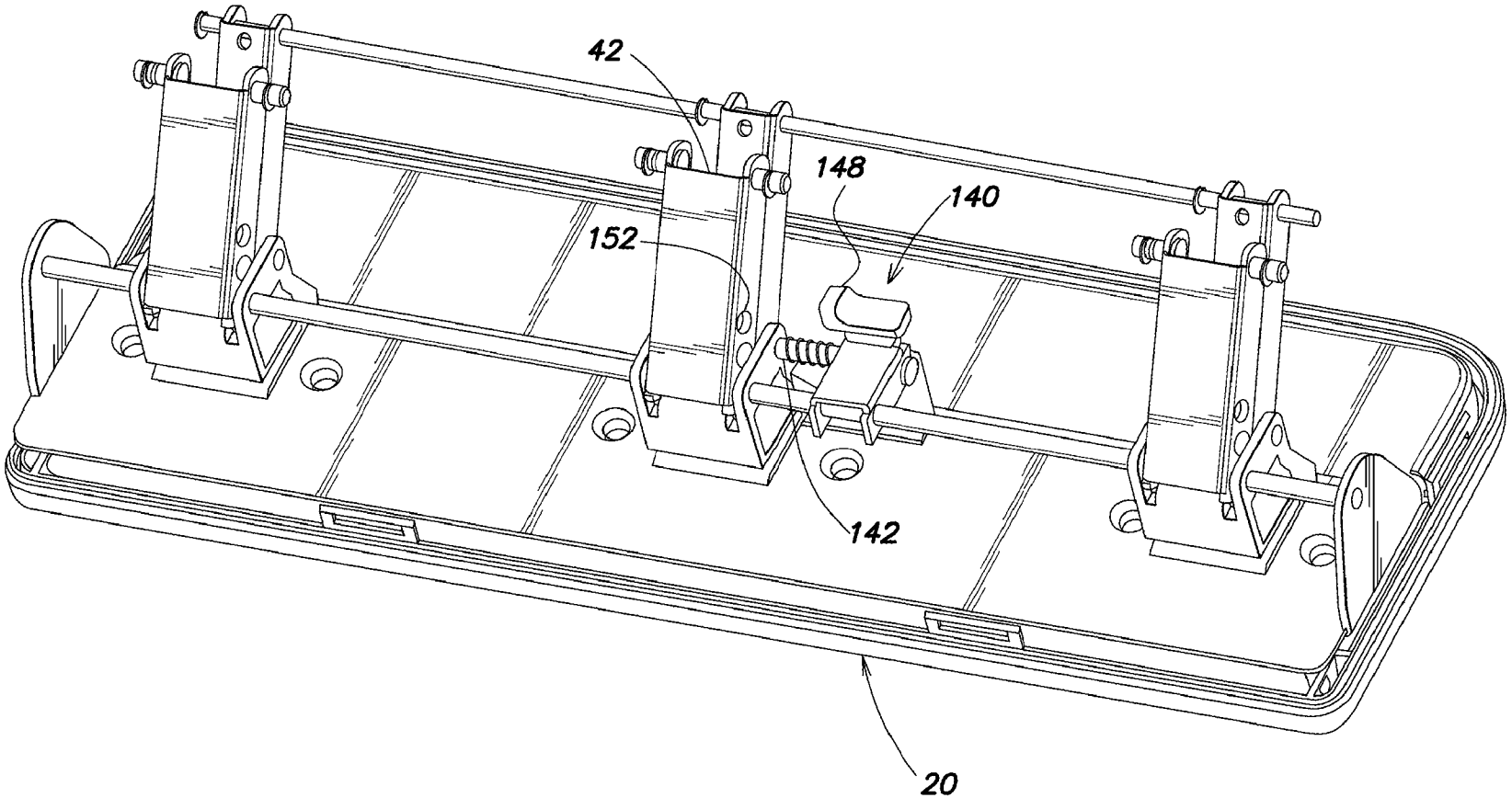
FIG. 14 is a perspective rear view of the hole punch shown in FIG. 13 in a partially assembled state.

In another embodiment illustrated in FIGS. 12-14, at least a portion of the lock 140 is positioned within the housing 22 of the hole punch 10. In this embodiment, the lock 140 includes a detent 142 arranged to be selectively engageable with the first linkage 42 of the handle assembly 40. To move the lock 140 between an unlocked and locked position, a slide member 148 is attached to the detent 142. In this particular embodiment, the detent 142 is configured to selectively move into the opening 24 in the housing 22. As shown in FIGS. 13 and 14, the detent 142 may be positioned near a punch head 18 and may be configured to slide into an opening 152 in the first linkage 42. The lock 140 may be configured to lock the hole punch 10 when the handle assembly 40 is in the punch position.

In one embodiment, the lock 140 may be configured such that when the detent 142 is in the locked position, a user may push downwardly on the third linkage 46 to disengage the detent 142 from the first linkage 42 to unlock the lock 140. In this embodiment, the detent 142 may be biased in its unlocked position with a spring. In another embodiment, the lock 140 may be configured such that a user disengages the detent 142 from the first linkage 42 by movement of the slide member 148.

The detent 142 may be configured to extend into the first linkage 42 when the first linkage 42 is recessed within the opening 24 in the housing 22 to prevent rotational movement of the first linkage 42 relative to the base 20. In this respect, the hole punch 10 may be locked in a collapsed stowed configuration. As shown in a comparison of FIG. 3 (which shows the pre-actuation position of the handle assembly) and FIG. 4 (which shows the punch position of the handle assembly), a hole punch 10 which is stowed in the collapsed punch position may take up less space than a hole punch stored in the pre-actuation position.

The hole punch 10 may include features to capture the resulting punched paper from the hole after a sheet of paper has been punched. These resulting chads may be held within a waste chamber 120 disposed below the punch heads 18. In one embodiment, as shown in FIGS. 6 and 7, this waste chamber 120 may be formed into the base 20. As shown in FIG. 7, the waste chamber 120 may include a door 124 pivotally coupled to the base 20 to provide access to the chamber 120. In one illustrative embodiment, the door 124 is on a bottom surface of the base 20.

Although a waste chamber 120 is employed, the present invention is not limited in this regard, as other suitable receptacles may be employed. In addition, no chamber need be employed and the chads may simply be expelled from the hole punch 10.

As can be appreciated, the hole punch may be formed of any suitable material, as the present invention is not limited in this regard. Similarly, the hole punch may be sized to accommodate any number of sheets including one, five, ten, twenty, forty or more sheets. In one embodiment, the base 20 and the handle assembly 40 is formed of metal, as is the punch head frame 94 and punch pin 98 itself. Other non-structural components may be formed of a lower strength material, such as plastic. As mentioned above, some components of the hole punch 10, such as the upper component 50 of the third linkage 46, may be formed of thermal plastic elastomer (TPE).

It should also be appreciated that the hole punch need not be configured to punch spaced holes in a sheet so that the sheet can be inserted into a standard 3-ring binder; rather the punch head spacing may be altered by the user or the manufacturer, as desired, as described above, as the present invention is not limited in this respect. Similarly, aspects of the invention are not limited to employing three punch heads, as aspects of the invention may be employed on hole punches having one, two, three, four, five, six, seven, eight, nine, ten, or more punch heads. Also, the size and/or shape of the actual holes to be punched may be varied depending upon the desired use for the hole punch.

The foregoing written specification is to be considered to be sufficient to enable one skilled in the art to practice the invention. While the best mode for carrying out the invention has been described in detail, those skilled in the art to which this invention relates will recognize various alternative embodiments including those mentioned above as defined by the following claims. The examples disclosed herein are not to be construed as limiting of the invention as they are intended merely as illustrative of particular embodiments of the invention as enabled herein. Therefore, systems and methods that are functionally equivalent to those described herein are within the spirit and scope of the claims appended hereto. Indeed, various modifications of the invention in addition to those shown and described herein will become apparent to those skilled in the art from the foregoing description and fall within the scope of the appended claims.

What is claimed is:

1. A hole punch, comprising:

a base;

a handle assembly constructed and arranged to move relative to the base;

at least one punch head mounted to the base, each punch head of the at least one punch head having a punch pin, with the handle assembly adapted to engage the punch pin and move the punch pin along a movement axis from a rest position to a deployed position upon actuation of the handle assembly; and wherein the base includes a housing at least partially enclosing the at least one punch head, and wherein the housing includes at least one opening wherein, in a first position, at least a portion of the handle assembly is not recessed within the at least one opening, and in a second position, the at least a portion of the handle assembly is recessed within the at least one opening;

wherein the handle assembly includes a linkage constructed and arranged to move in a linear direction to initiate movement of the punch pin into the deployed position, the linkage being constructed and arranged such that, when the handle assembly is in the second position, the movement axis of the punch pin does not intersect the linkage.

2. The hole punch of claim 1, wherein the linkage is constructed and arranged to move substantially parallel to at least a top surface of the base.

3. The hole punch of claim 1, wherein the base further comprises:

a chamber positioned beneath the at least one punch head to capture a resulting chad after paper is punched; and a door pivotally coupled to the base to provide access to the chamber.

4. The hole punch of claim 1, wherein the handle assembly is movable from a pre-actuation position to a punch position, wherein the hole punch further comprises a lock constructed and arranged to engage the handle assembly and hold the handle assembly in a stowed configuration located at or between the pre-actuation position and the punch position.

5. The hole punch of claim 4, wherein at least a portion of the lock is positioned within the housing and wherein the lock includes a detent constructed and arranged to be selectively engageable with the handle assembly.

6. The hole punch of claim 5, wherein the lock further comprises a slide member coupled to the detent.

7. The hole punch of claim 1, wherein the housing encloses a substantial portion of the at least one punch head.

8. The hole punch of claim 1, wherein the housing includes at least a second opening constructed and arranged to receive paper into the housing.

9. The hole punch of claim 1, wherein the linkage is arranged such that, when the handle assembly is in the first position, the movement axis of the punch pin does not intersect the linkage.

10. The hole punch of claim 1, wherein:

the base comprises a first surface;

the linkage comprises a second surface; and the linkage is constructed and arranged such that, when the handle assembly moves from the first position to the second position, the second surface remains parallel to the first surface.

11. The hole punch of claim 1, wherein the handle assembly further comprises a second linkage constructed and arranged to rotate around a fixed point as the handle assembly moves from the first position to the second position.

12. A hole punch, comprising:

a base;

a handle assembly constructed and arranged to move relative to the base;

at least two punch heads mounted to the base, each punch head of the at least two punch heads having a punch pin, with the handle assembly adapted to engage the punch pin and move the punch pin from a rest position to a deployed position upon actuation of the handle assembly; and wherein the handle assembly includes at least two linkage pairs, each linkage pair of the at least two linkage pairs corresponding to a punch head of the at least two punch heads, and wherein each linkage pair comprises:

a first linkage pivotally coupled to the base and a second linkage pivotally coupled to the base, the first linkage being substantially parallel to the second linkage when the punch pin of the punch head corresponding to the linkage pair is in the rest position, and wherein the second linkage is configured to nest within the first linkage when the punch pin is in the deployed position such that the first linkage is collapsible over the second linkage, and wherein the first linkage extends over the punch pin, and the second linkage is offset from the punch pin such that it does not extend over the punch pin.

13. The hole punch of claim 12, further comprising a third linkage pivotally coupled to both the first linkage and the second linkage, and wherein the third linkage is constructed and arranged to move substantially parallel to at least a portion of the base.

14. The hole punch of claim 12, wherein the base includes a housing at least partially enclosing the at least two punch heads, and wherein the housing includes at least one opening wherein at least a portion of the handle assembly is adapted to be recessed within the at least one opening.

15. The hole punch of claim 12, wherein at least one first linkage of the at least two linkage pairs has a substantially U-shaped cross-section.

16. The hole punch of claim 15, wherein at least one second linkage of the at least two linkage pairs has a substantially U-shaped cross-section.

17. A hole punch comprising:

a base;

a handle assembly constructed and arranged to move relative to the base;

at least two punch heads mounted to the base, each punch head of the at least two punch heads having a punch pin, with the handle assembly adapted to engage the punch pin and move the punch pin from a rest position to a deployed position upon actuation of the handle assembly; and wherein the handle assembly includes at least two linkage pairs, each linkage pair of the at least two linkage pairs corresponding to a punch head of the at least two punch heads, and wherein each linkage pair comprises:

a first linkage pivotally coupled to the base and a second linkage pivotally coupled to the base, the first linkage being parallel to the second linkage when the punch pin of the punch head corresponding to the linkage pair is in the rest position, and wherein the second linkage is configured to nest within the first linkage when the punch pin is in the deployed position such that the first linkage is collapsible over the second linkage, and wherein the first linkage extends over the punch pin, and the second linkage is offset from the punch pin such that it does not extend over the punch pin.

* * * * *